US010961035B2

(12) United States Patent
Weyrauch

(10) Patent No.: US 10,961,035 B2
(45) Date of Patent: Mar. 30, 2021

(54) PALLET CONTAINER INCLUDING FEET CLEARANCE

(71) Applicant: MAUSER-WERKE GMBH, Bruehl (DE)

(72) Inventor: Detlev Weyrauch, Kreuzau-Untermaubach (DE)

(73) Assignee: MAUSER-WERKE GMBH, Bruehl (DE)

( * ) Notice: Subject to any disclaimer, the term of this patent is extended or adjusted under 35 U.S.C. 154(b) by 241 days.

(21) Appl. No.: 16/088,933

(22) PCT Filed: Apr. 7, 2017

(86) PCT No.: PCT/EP2017/000438
§ 371 (c)(1),
(2) Date: Sep. 27, 2018

(87) PCT Pub. No.: WO2017/174198
PCT Pub. Date: Oct. 12, 2017

(65) Prior Publication Data

US 2020/0324954 A1 Oct. 15, 2020

(30) Foreign Application Priority Data

Apr. 7, 2016 (DE) ..... 20 2016 002 161.4

(51) Int. Cl.
*B65D 77/04* (2006.01)
*B65D 19/10* (2006.01)

(52) U.S. Cl.
CPC ..... *B65D 77/0466* (2013.01); *B65D 19/10* (2013.01); *B65D 2213/00* (2013.01);
(Continued)

(58) Field of Classification Search
CPC ..... B65D 19/00; B65D 19/08; B65D 19/10; B65D 21/02; B65D 77/04; B65D 77/0466;
(Continued)

(56) References Cited

U.S. PATENT DOCUMENTS 4,676,373 A * 6/1987 Schneider ..... B65D 19/08 206/386
4,947,988 A 8/1990 Schutz
(Continued)

FOREIGN PATENT DOCUMENTS

CN 1066036 A 11/1992
CN 1102389 A 5/1995
(Continued)

OTHER PUBLICATIONS

International Search Report for International Search Application No. PCT/EP2017/000438, dated May 26, 2017.
(Continued)

*Primary Examiner* — Bryon P Gehman
(74) *Attorney, Agent, or Firm* — Marshall, Gerstein & Borun LLP

(57) ABSTRACT

A pallet container having a thin-walled rigid plastics material inner container, a tubular lattice frame of horizontal and vertical tubular bars as a supporting jacket, and a base pallet on which the plastics-material inner container bears and to which the tubular lattice frame is fixedly connected. The base pallet is configured as a frame pallet having corner feet and central feet and a clearance in the corner feet and the central feet is provided on the base. The clearance is configured such that when stacking two pallet containers the uppermost encircling horizontal tubular bar of the tubular lattice frame of a pallet container stacked therebelow engages or "nests" in a mutually adapted and form-fitting
(Continued)

manner in the clearance. a secure transportation of two stacked pallet containers, a deeper clearance is formed such that it is deeper in the vertical direction than in the horizontal or radial direction.

8 Claims, 5 Drawing Sheets

(52) U.S. Cl.
CPC ..... *B65D 2519/008* (2013.01); *B65D 2519/00024* (2013.01); *B65D 2519/00034* (2013.01); *B65D 2519/00273* (2013.01); *B65D 2519/00815* (2013.01)

(58) Field of Classification Search
CPC ..... B65D 2213/00; B65D 2519/00024; B65D 2519/00034; B65D 2519/00273; B65D 2519/008; B65D 2519/00815
USPC ..... 206/386; 220/9.1–9.4
See application file for complete search history.

(56) References Cited

U.S. PATENT DOCUMENTS 5,110,000 A 5/1992 Nichols
5,253,777 A * 10/1993 Schutz ..... B65D 77/0466 206/386
5,507,392 A 4/1996 Schutz
5,678,688 A * 10/1997 Schutz ..... B65D 77/0466 206/386
6,024,237 A * 2/2000 Burgdorf ..... B65D 77/0466 220/1.5
7,036,662 B2 * 5/2006 Schutz ..... B65D 77/0466 206/386
9,045,267 B2 * 6/2015 Schutz ..... B65D 77/0466

FOREIGN PATENT DOCUMENTS

CN 1111209 A 11/1995
CN 2801667 Y 8/2006
DE 3819911 A1 12/1989
DE 3907717 A1 9/1990
DE 10301517 B3 3/2004
EP 0461666 A1 12/1991
EP 1375382 B2 7/2013
WO WO-2012085941 A1 6/2012

OTHER PUBLICATIONS

Search Report for the State Intellectual Property Office of People's Republic China, Application No. 201780022455.5, dated Oct. 8, 2019.

* cited by examiner

PALLET CONTAINER INCLUDING FEET CLEARANCE

CROSS-REFERENCE TO RELATED APPLICATION

This is the United States national phase of International Patent Application No. PCT/EP2017/000438, filed Apr. 7, 2017, which claims priority to German Application No. 20 2016 002 161.4 filed Apr. 7, 2016, the entire contents of each of which are hereby incorporated by reference.

FIELD OF THE DISCLOSURE

The invention relates to a pallet container (IBC) for storing and for transporting in particular hazardous liquid or free-flowing filling materials, having a thin-walled rigid inner container from a thermoplastic plastics material, having a tubular lattice frame of horizontal and vertical tubular bars which are welded to one another, said tubular lattice frame as a supporting jacket tightly enclosing the plastics-material inner container, and having a base pallet on which the plastics-material inner container bears and to which the tubular lattice frame is fixedly connected, wherein the base pallet is configured as a composite embodiment or as a frame pallet having corner feet and central feet from plastics material, steel, or timber, and encircling base steel tubing therebelow, wherein for stacking pallet containers of identical types on top of one another a clearance in the corner feet and the central feet is provided on the base along the external edges of all four sidewalls of the base pallet, said clearance being configured such that when stacking two pallet containers on top of one another, the uppermost encircling horizontal tubular bar of the tubular lattice frame of a pallet container stacked therebelow engages or "nests" in a mutually adapted and form-fitting manner in an exact fit in the clearance.

BACKGROUND

Pallet containers of this type, used particularly frequently in the chemical industry, having a filling volume of approx. 1000 liters have standardized dimensions. The pallet containers discussed here have a length of approx. 1200 mm, a width of approx. 1000 mm, and a height of approx. 1151 mm, and in the filled state may only be transported as a two-tier stack (one IBC on the bottom and one IBC stacked thereon). For long distance transportation by rail or truck or overseas by ship closed 20 foot or 40 foot ISO containers are typically used. Said ISO containers (for example, Maersk) likewise have standardized dimensions (20 foot container: length approx. 6058 mm, width approx. 2500 mm, height approx. 2591 mm; the 40" container being exactly double the length, with all other dimensions remaining the same) and are loaded and unloaded by way of a rear door. For the loading of ISO containers, this applying likewise to both sizes (Hapag Lloyd), the width of approx. 2343 mm, on the one hand, and in particular the height of approx. 2292 mm, on the other hand, of the door opening is of great importance. Unfortunately, a two-tier stack of filled pallet containers in the standard embodiment results in a stack height of approx. 2290 mm that has to be taken into account. The purely mathematical double height of two pallet containers would be 2×1151 mm=2302 mm. The lower value of approx. 2290 mm is the result of the pallet container stacked on top, due to its encircling base steel tubing on the base by way of a small measure of 15.5 mm within the uppermost horizontal encircling tubular bar of the tubular lattice frame plunging or "nesting" into said tubular lattice frame until the corner feet and central feet that externally project beyond the base steel tubing come to bear from above onto the uppermost horizontally encircling tubular bar. The uppermost horizontally encircling tubular bar of the tubular lattice frame herein engages on the external side past the base steel tubing into a head space that is configured there, or into a clearance on the lower external periphery of the corner feet and central feet, respectively, such that a safeguard against the pallet container stacked on top from shifting due to this transportation vibrations is provided on account thereof.

Tight limits are predefined in terms of the construction of the design type of the IBCs, wherein the "approximate values" for the length measurement in the present dimension are all to include a range of plus/minus 2 mm. The usual nesting depth is approx. 15.5 mm; the actual height of a stack of two IBCs would thus be (2×1151−15.5)=approx. 2286.5 mm. By virtue of the tolerances of in each case plus/minus 2 mm, the stack height to be taken into account for safety reasons is considered to be 2290 mm.

A similar pallet container having a timber pallet is described as an "intermediate bulk container of low height" in the publication EP 1 375 382 B2 (vL). The lowermost encircling horizontal tubular ring of the tubular lattice frame herein is not simply placed, like the plastics-material inner container, on top of the upper plank base as usual, but circumferentially encompasses the plank base and sits on a lower-lying encircling external shoulder, on the one hand. On the other hand, it is proposed that the drive-in height of the lateral rectangular pallet clearances for the engagement of the forks of a fork lift truck are reduced by way of a lower height of the corner feet and central feet. This in both cases results in a reduction in the overall height of the individual pallet container. This is disadvantageous in as much as pallet containers as standardized containers having predefined dimensions only represent one link in the logistics chain of the chemical industry. Any deviations from standard dimensions can lead to significant disruptions in the production process of chemical mass products such that the customers of large chemical industries no longer demand such containers. Pallet containers having a reduced overall height can lead to disruptions, for example, in the case of fully automatic filling systems, and pallet containers having a reduced drive-in height can in this instance only be handled using fork lifting gear having relatively thin prongs. Pallet containers of this type can in this instance no longer be picked up and transported by standardized lifting trucks on rollers.

GENERAL DESCRIPTION

It is an object of the present invention to overcome the existing disadvantages of the prior art and to specify a pallet container (=IBC) of which the overall height remains the same as compared to a standard pallet container, which however when stacked in two tiers can be loaded through the rear door of an ISO container by means of a fork lift truck.

This object is achieved by the special features of patent claim 1. The features in the dependent claims describe further advantageous possibilities in terms of the design embodiments of the pallet container according to the invention. The technical teaching proposed opens up an improved use of IBCs having a frame pallet for transportation in ISO containers. This is effectively caused in that in the case of the base pallet of the pallet container the clearance on the external side of the base steel tubing on the lower external periphery of the corner feet and central feet in the vertical direction is configured so as to be deeper than in the horizontal or radial direction, specifically up to double the depth (or height, respectively) than in the horizontal or radial direction. On account thereof, the pallet container placed on top can sink, that is to say "nest" significantly deeper, that is to say for example to double the depth as in the prior art, or even deeper, into the lower pallet container, so that the overall height of the two-tier stack is reduced by an amount, and this small head space gained is sufficient in order for a two-tier stack on the forks of a fork lift truck to be transported and loaded into the ISO container through the rear door that is limited in height. The overall height of each individual pallet container herein remains identical to the standard height such that no problems can arise in filling plants.

In the constructive design embodiment of the invention it is provided in a concrete manner herein that the clearance on the lower external periphery of the corner feet and central feet in the horizontal or radial direction is configured so as to be 20 mm to 25 mm plus/minus 2 mm deep, and in the vertical direction so as to be 25 mm to 40 mm plus/minus 2 mm deep. On account of this measure which is simple per se, a saving in terms of material is incidentally also achieved on the corner feet and central feet without a trade-off in terms of any loss of strength. In the stacking of two pallet containers on top of one another, the uppermost encircling horizontal tubular bar of the tubular lattice frame of the lower stacked pallet container, in a manner engaging in the lower external periphery of the base pallet of the upper stacked pallet container, herein comprises said lower external periphery of the base pallet up to a height of approximately 40 mm.

In the case of the solution according to the invention, a reduced height of 2250 mm to 2270 mm of a "tower" stacked in a two-tier manner is thus realized so as to correspond to the nesting of the pallet container stacked on top, said nesting being deeper by 20 mm to 40 mm plus/minus 2 mm. This now suffices in order for a two-tier stack, that is to say two pallet containers simultaneously, to be transported on the forks of a fork lift truck through the rear door into a 20 foot or 40 foot ISO container and to be stowed in two-tier stacks in the internal cargo space. On account thereof, a 20 foot ISO container can be loaded with 20 units of the pallet containers according to the invention and of course also unloaded again later in half the time, as compared to 18 units of standard pallet containers being loaded individually. By virtue of the sufficient spacing from the upper door frame, four IBCs can now also be stored in the last row, this previously having been possible for only two IBCs.

In the case of the pallet container version having a larger nesting depth, the drive-in height of still 100 mm for the forks of a fork lift truck or of a lifting truck on rollers is advantageously not changed, and the overall height of the individual pallet container also remains the same. This is very important for the disruption-free functioning of the automatic filling installations of large industrial customers.

In a design embodiment of the invention it is provided that the uppermost encircling horizontal tubular bar of the tubular lattice frame is reinforced by two transverse stays which are fastened at two opposite external sides of the horizontal tubular bar, by means of in each case one U-shaped tubular end having two mutually screw-fitted legs of the U-shaped tubular ends that engages across the horizontal tubular bar, wherein flathead furniture screws are in each case screwed in for screw-fitting the tubular end legs. When stacking two pallet containers with a larger nesting depth on top of one another, in the case of the composite pallet, the encircling base tubular bar below the plastics-material corner feet and central feet comes to bear directly on the two transverse stays and on the inner legs of the U-shaped tubular ends, said bearing being supported in a downward and lateral manner.

BRIEF DESCRIPTION OF THE DRAWINGS

The invention will be explained and described in more detail hereunder by means of preferred exemplary embodiments illustrated in the drawings in which.

DETAILED DESCRIPTION

Figure 1:
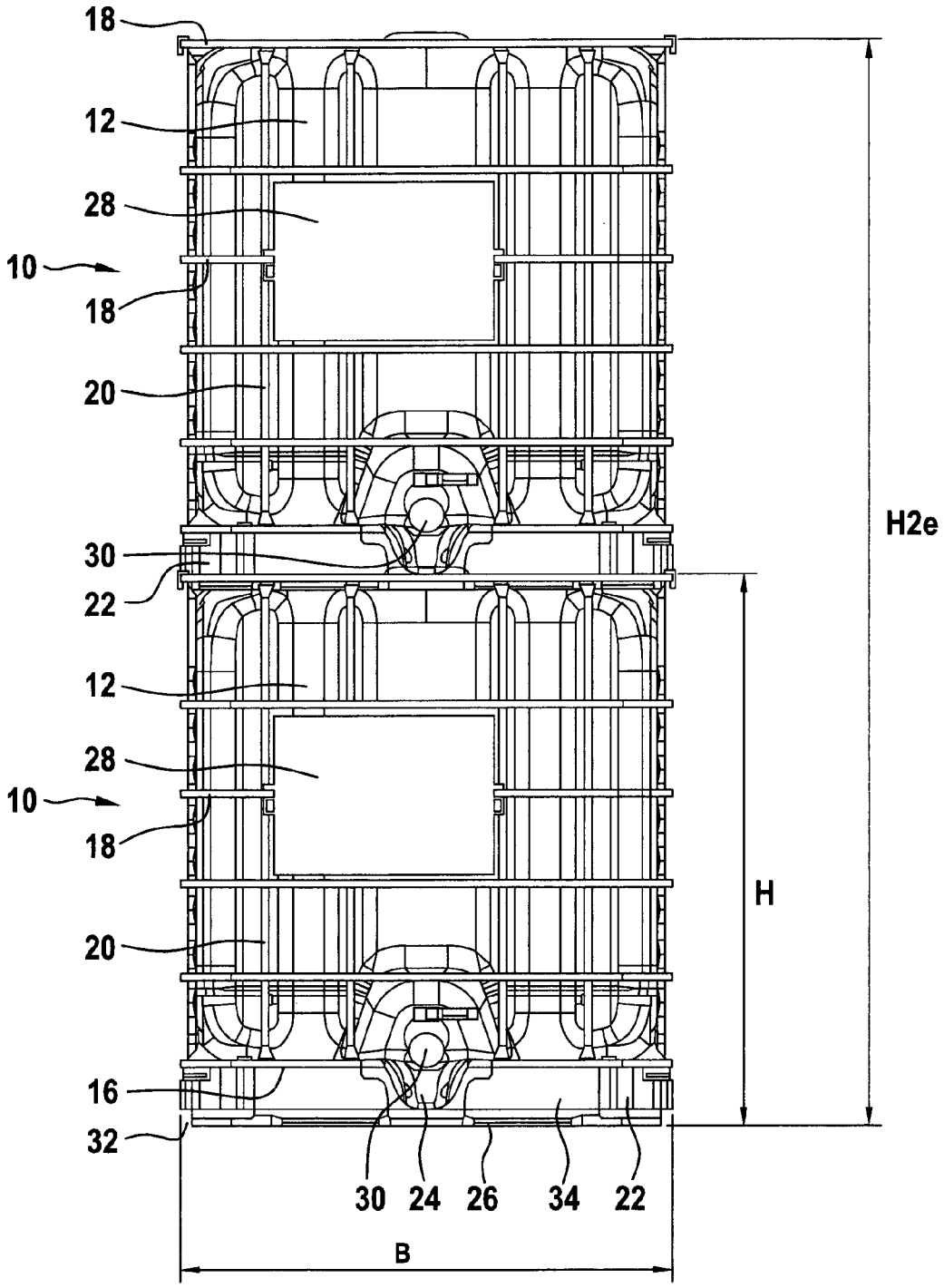
FIG. 1 shows a stack of two IBCs according to the invention in a front view.

A two-tier stack of two pallet containers stacked of top according to the invention for storing and for transporting in particular hazardous liquid or free-flowing filling materials is illustrated in FIG. 1, said pallet containers being in each case identified by the reference sign 10. The pallet containers 10 have in each case a filling volume of approx. 1000 l and standardized dimensions of approx. 1200 mm in length, approx. 1000 mm in width B, and approx. 1151 mm in height H. These approximate values in the present dimension are all intended to include a range of plus/minus 2 mm as the constructive design type of IBCs predefines tight limits. The main elements of the pallet containers 10 are composed of a thin-walled rigid inner container 12 from a thermoplastic plastics material, of a tubular lattice frame 14 as a supporting jacket tightly enclosing the plastics-material inner container 12, and of a base pallet 16 on which the inner container 12 bears and to which the tubular lattice frame 14 is fixedly connected. The tubular lattice frame 14 (outer container) is composed of horizontal and vertical tubular bars 18, 20 that are welded to one another. In order to obtain a closed outer container, the annularly encircling horizontal tubular bars 18 are each fixedly connected to one another at a connecting point. The base pallet 16 in the exemplary embodiment illustrated is configured as a composite pallet having an upper support plate from steel sheet for supporting the plastics-material inner container 12, having a tubular steel support frame that is disposed therebelow, having corner feet 22 and central feet 24 that in the injection-molding method are produced from thermoplastic plastics material, and an encircling base tubular bar structure 26 from steel tubing below the corner feet 22 and central feet 24. Alternatively however, the pallet could also be configured as a steel pallet, for example. A labeling board 28 from thin metal sheet for identifying the respective liquid filling material is fastened at mid-height of the tubular lattice frame 14 on the front side illustrated of the IBC 10. A retrieval fitting 30 for retrieving the liquid filling material is connected in the center of the base of the plastics-material inner container 12.

For stacking pallet containers 10 of identical types on top of one another a clearance 32 in the corner feet 22 and the central feet 24 is provided on the base along the external edges of all four sidewalls of the base pallet 16, said clearance 32 being configured such that when stacking two pallet containers 10 on top of one another, the uppermost encircling horizontal tubular bar 20 of the tubular lattice frame 14 of a pallet container 10 stacked therebelow engages or nests, respectively, in a form-fitting manner in an exact fit into the clearance 32. Respective clearances 34 for the engagement of forks of a fork lift truck 36 or a lifting truck on rollers are provided between the corner feet 22 and the central feet 24 on all four sides of the base pallet 16. By virtue of the measures according to the invention a height H2*e* of the two-tier stack of IBCs according to the invention of 2250 mm to 2270 mm results.

Figure 2:
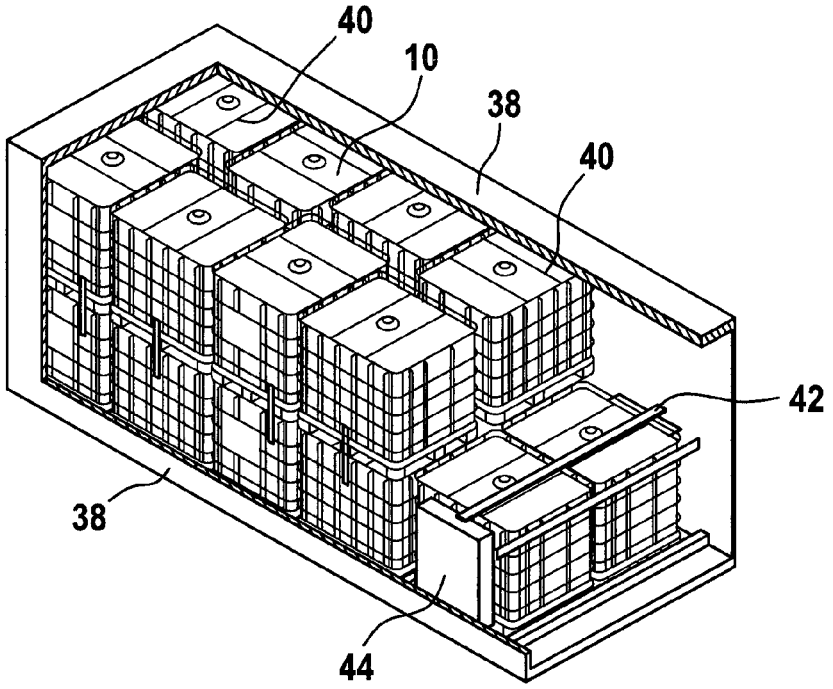
FIG. 2 shows a 20 foot ISO container having 18 standard IBCs stowed therein in a perspective partial sectional view.

FIG. 2 shows a 20 foot ISO container 38 loaded with 18 units of standard IBCs according to the prior art. The loading of the ISO container 38 is performed by means of a fork lift truck 36 having in each case one pallet container 10 on the fork, because two pallet containers 10 received in the stack by virtue of the limited height of the door opening HT of 2292 mm do not fit on top of one another through the rear door. Moreover, the IBCs have to be stacked in a row beside one another in an alternating manner once in the longitudinal direction and once in the transverse direction in order for the best utilization of space to be obtained. This can be very well seen in FIG. 2 by way of the two transverse supports 40 which in each case run transversely across the upper base of the plastics-material inner container 12. The upper two IBCs in the last-but-one row, and the two IBCs in the last row ahead of the rear door, moreover have to be fixed for transportation by means of respective transportation securing measures such as tension straps 42 and holding plates 44. On account of the two upper IBCs in the last row no longer being able to be stacked, 10% of the cargo space remains non-utilized.

Figure 3:
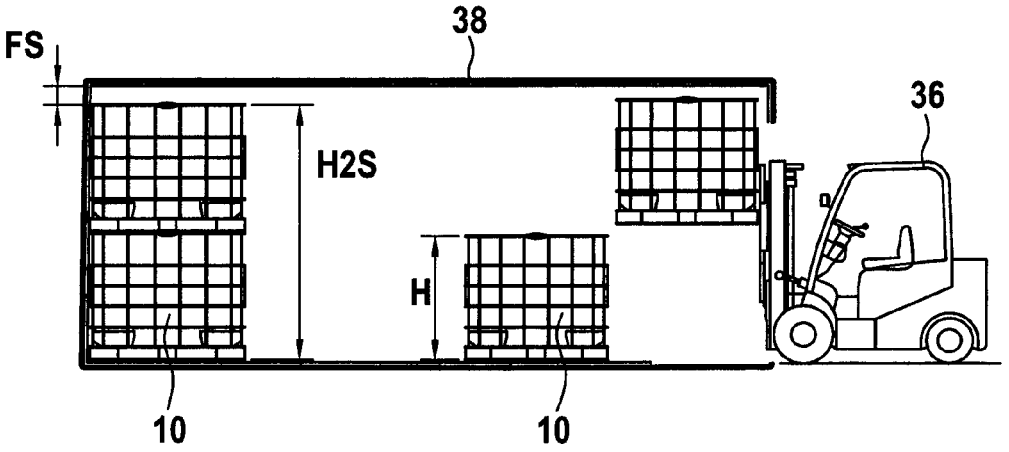
FIG. 3 shows a longitudinal section through a 20 foot ISO container in a loading procedure by means of a fork lift truck.

A 20 foot ISO container 38 in which two standard IBCs are stored so as to be stacked on top of one another on the rear wall is illustrated in the same manner in FIG. 3. The two-tier stack has a height H2S of 2290 mm. In the case of an internal height of 2385 mm in the ISO container (Hapag Lloyd), this results in a head space FS of 95 mm for the upper standard IBC (in the case of a nesting of 15.5 mm). In order for the upper standard IBC to be lifted, the fork lift first has to lift the IBC by at least 25 mm beyond the nesting in the vertical direction so as to be able to then move said upper standard IBC in the horizontal direction out of the ISO container 38 in a remaining vertical head space of 70 mm upward. Ahead of the rear door, the IBC then has once again to be lowered so far that said IBC can pass below the upper edge of the rear door.

Figure 4:
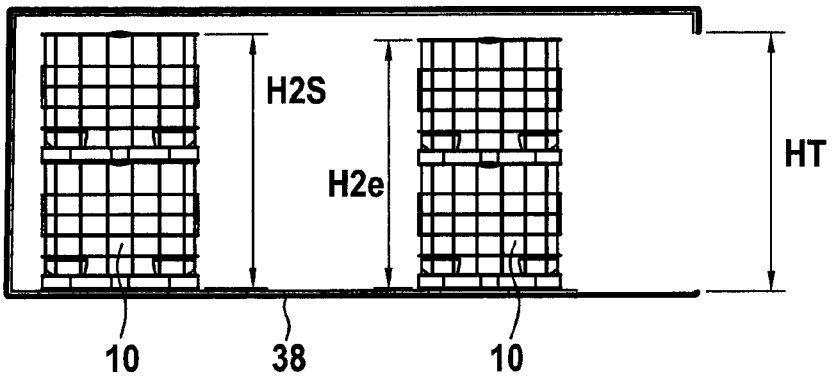
FIG. 4 shows a longitudinal section through the 20 foot ISO container, having in each case one two-tier stack of standard IBCs and IBCs according to the invention.

In the case of the ISO container 38 illustrated in FIG. 4 a two-tier stack of conventional standard IBCs having a stack height H2S of 2290 mm can be seen in a comparative manner on the left, while a two-tier stack of IBCs according to the invention having a deeper nesting (plus 20 mm to 40 mm) having a stack height H2*e* of 2250 mm to 2270 mm is illustrated on the right. It becomes evident therefrom that the right stack having both IBCs in the stack can be unloaded in "one go" through the rear door, while the left stack first has to be unstacked and the IBCs have to be individually conveyed out, first the top and then the lower IBC.

Figure 5:
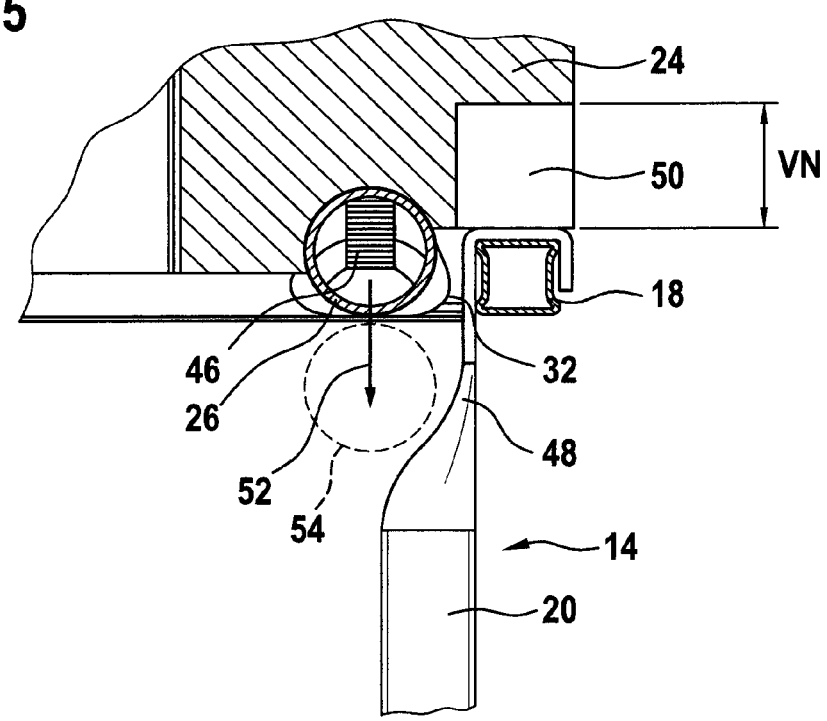
FIG. 5 shows a partial sectional view through the external periphery of the base pallet of an IBC stacked on top and through the upper region of the tubular lattice frame of an IBC stacked below.

The structural shape of a supporting element is specifically represented in a perspective view in FIG. 5. The fragment in the shape of a part-circle shows a lower right corner of a central foot 24 produced from plastic in the injection-molding method. The horizontally encircling base tubular bar structure 26 can be seen approximately centrally, in cross-sectional view, in the base face of the plastics-material central foot 24, said base tubular bar structure 26 being fixedly screw-fitted by means of a countersunk screw 46. A clearance 32 in which the uppermost horizontally encircling tubular bar 18 of the tubular lattice frame 14 engages is configured toward the lower external periphery of the central foot 24, to the right next to the base tubular bar structure 26. The uppermost horizontally encircling tubular bar 18 is fixedly welded to the upper pressed-flat end 48 of all vertical tubular bars 20. In the case of the solution according to the invention, the clearance 32, when viewed in the cross section, has been enlarged by an additional approx. 20 mm to 40 mm so as to form a depressed clearance 50 which in the vertical direction is configured so as to be deeper, specifically up to double the depth or the height, respectively, than in the horizontal or radial direction. The depressed clearance 50 comprises or contains, respectively, the previous clearance 32 and in the horizontal or radial direction is configured so as to be 20 mm to 25 mm plus/minus 2 mm deep, and in the vertical direction so as to be 25 mm to 40 mm plus/minus 2 mm deep.

On account of two IBCs according to the invention having a depressed clearance 50 (when viewed in the cross section) being stacked on top of one another, the uppermost encircling horizontal tubular bar 18 of the tubular lattice frame 14 of the pallet container stacked therebelow, in a manner engaging from below into the depressed clearance 50, comprises the lower external periphery of the base pallet 16 of the pallet container 10 stacked on top up to a height of approximately 40 mm plus/minus 2 mm, this results, on the one hand, in an overall height of the IBC stack that is reduced by 20 mm to 40 mm plus/minus 2 mm, this enabling transportation of two IBCs on top of one another (a stack) on the forks of a fork lift truck through the rear door of an ISO container and, on the other hand, advantageously has the effect of an increased safeguard against shifting of the IBC stacked on top in the case of transportation vibrations and excessive cornering of the transport vehicle.

In the case of the "deeper nesting" the upper IBC sinks deeper into the lower IBC, as is schematically indicated in FIG. 5, such that the uppermost encircling horizontal tubular bar 18 is now positioned in the upper half of the depressed clearance 50, and the horizontally encircling base tubular bar structure 26 on the base is displaced according to the displacement arrow 52 to a low-slung "nesting position" 54.

Figure 6:
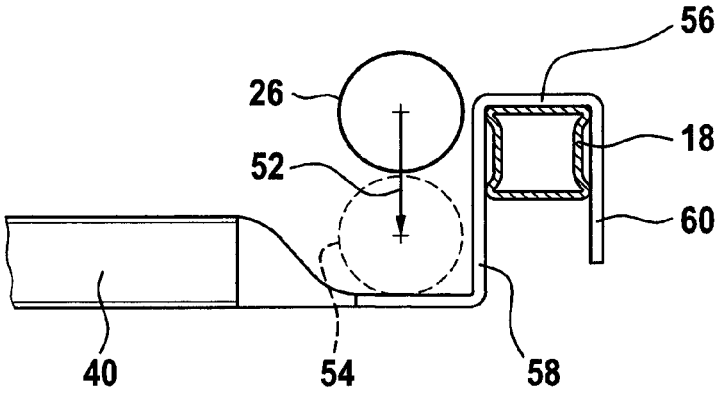
FIG. 6 shows a schematic partial view onto the region of the external periphery of the base pallet of an IBC stacked on top and onto the upper region of the tubular lattice frame of an IBC stacked below.

Said "deeper nesting" in FIG. 6 is schematically highlighted on a tubular transverse support 40, wherein the tubular transverse support 40 at the two outer ends thereof (only the right side being illustrated here) is pressed flat and shaped to a U-shaped tubular end 56 having an outer leg 60 and an inner leg 58 in such a manner that said transverse support 40 is placed in an exact fit onto the uppermost encircling horizontal tubular bar 18. The two legs 58, 60 of the U-shaped tubular ends 56 below the encircling horizontal tubular bar 18 are mutually screw-fitted by means of flathead furniture screw 62. Only the encircling base tubular bar structure 26 (in the cross-section) of an IBC stacked on top is illustrated here as an upper circle. Previously, the base tubular bar structure 26 plunged approximately half-way into the internal side behind the uppermost encircling horizontal tubular bar 18. The displacement arrow 52 shows the base tubular bar structure 26 as the latter has been displaced according to the present invention into the advantageous low-slung "nesting position" 54.

Figure 7:
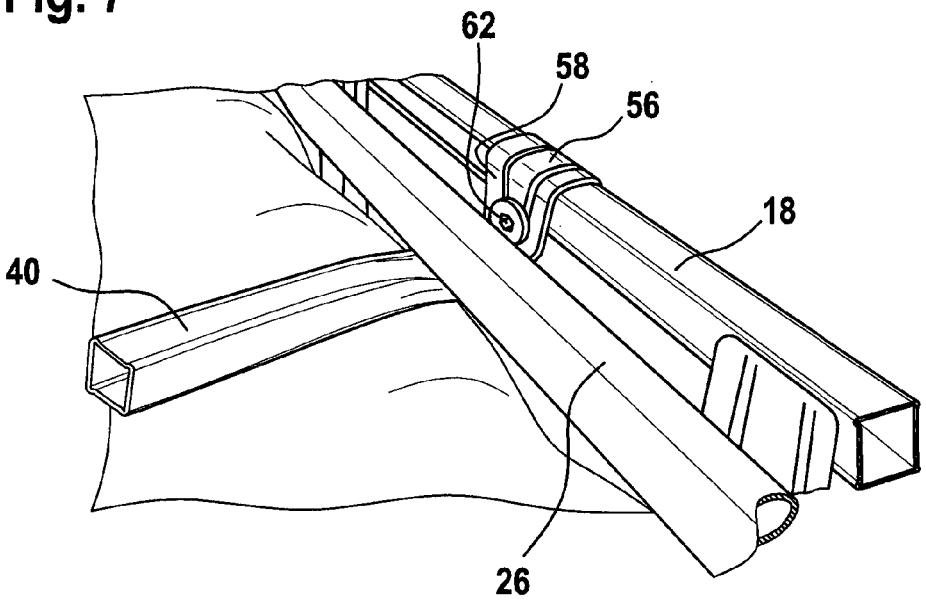
FIG. 7 shows a perspective partial view onto the upper peripheral region of an IBC stacked below.
Figure 8:
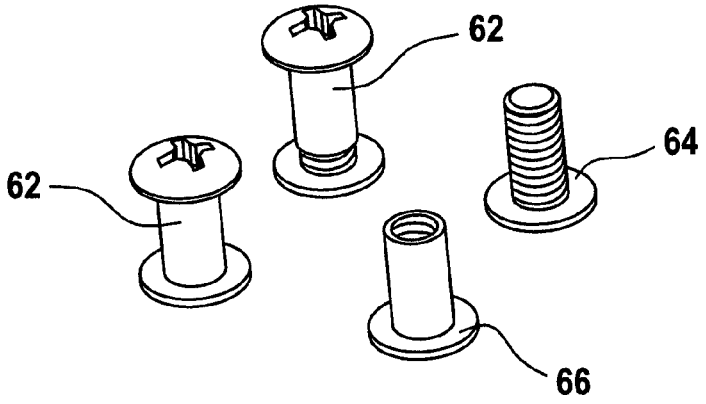
FIG. 8 shows a perspective view onto three sets of furniture screws for the IBCs according to the invention.

Finally, FIG. 7 shows an illustration in which only a short piece of the deeply nested base tubular bar structure 26 of an IBC stacked on top can be seen. It becomes evident herein that in the case of two IBCs being stacked on top of one another at an enlarged nesting depth, in the case of the composite pallet the encircling base steel tubing 26 below the plastics-material corner feet and central feet comes to bear directly on the pressed-flat ends of the two transverse supports 40 and on the inner legs 58 of the U-shaped tubular ends 56, said bearing being supported in a downward lateral manner.

The present solution according to the invention provides the advantage that two pallet containers stacked having a unit height of in each case 1151 mm on top of one another, by sinking the upper pallet container into the lower pallet container (=nesting) in total have an overall stack height H2*e* of only approx. 2250 mm to 2270 mm and thus are configured so as to be capable of being driven and stacked by means of a fork lift truck in a two-tier stack, that is to say in the state stacked on top of one another, through the rear door of a 4" ISO container having an opening height HT of the rear door of approx. 2292 mm.

It becomes evident from the preceding description and the illustrations of the figures that a substantial disadvantage of the prior art can be readily addressed by the technical teaching of the present invention, and a large effect can be achieved by way of a minor constructive modification.

The invention claimed is:

1. A pallet container for storing and for transporting free-flowing filling materials, having a thin-walled rigid plastic material inner container, having a tubular lattice frame of horizontal and vertical tubular bars which are welded to one another, said tubular lattice frame as a supporting jacket tightly enclosing the plastics-material inner container, and having a base pallet on which the plastics-material inner container bears and to which the tubular lattice frame is fixedly connected, the base pallet having four sidewalls, wherein the base pallet is configured as a composite embodiment or as a frame pallet having corner feet and central feet from plastics material, steel, or timber, and encircling base steel tubing therebelow, wherein for stacking pallet containers of identical types on top of one another a clearance in the corner feet and the central feet is provided on a base along the external edges of all four sidewalls of the base pallet, said clearance being configured such that when stacking two pallet containers on top of one another, the uppermost encircling horizontal tubular bar of the tubular lattice frame of a pallet container stacked therebelow engages in a mutually adapted and form-fitting manner in an exact fit in the clearance, characterized in that the clearance in the vertical direction is configured so as to be deeper, up to double the depth or height, respectively, than in the horizontal or radial direction.

2. The pallet container as claimed in claim 1, characterized in that the clearance in at least one of the horizontal direction and the radial direction is configured so as to be 20 mm to 25 mm plus or minus 2 mm deep, and in the vertical direction so as to be approximately 40 mm plus or minus 2 mm deep.

3. The pallet container as claimed in claim 1, characterized in that the uppermost encircling horizontal tubular bar of the tubular lattice frame of the pallet container stacked below, in a manner engaging in a lower external periphery of the base pallet of the pallet container stacked on top, comprises said lower external periphery of the base pallet up to a height of approximately 40 mm.

4. The pallet container as claimed in claim 1, characterized in that the uppermost encircling horizontal tubular bar of the tubular lattice frame is reinforced by two transverse stays which are fastened at two opposite external sides of the horizontal tubular bar, by means of in each case one U-shaped tubular end having two mutually screw-fitted legs of the U-shaped tubular ends that engages across the horizontal tubular bar, wherein flathead furniture screws are in each case screwed in for screw-fitting the screw-fitted legs of the U-shaped tubular ends.

5. The pallet container as claimed in claim 1, characterized in that when stacking two pallet containers on top of one another, in the case of an embodiment having a composite base pallet, the encircling base steel tubing below the corner feet and the central feet from plastics material comes to bear directly on the two transverse supports and the inner legs of the U-shaped tubular ends.

6. The pallet container as claimed in claim 1, characterized in that when stacking two pallet containers on top of one another, a lower external periphery of the base pallet up to the end face of the clearance across a height of approximately 40 mm plus or minus 2 mm is configured so as to engage on the internal side along the uppermost encircling horizontal tubular bar of the tubular lattice frame of the pallet container stacked below.

7. The pallet container as claimed in claim 1, characterized in that when stacking two pallet containers on top of one another having a unit height H of in each case approximately 1151 mm by sinking the upper pallet container into the lower pallet container in total an overall stack height H2*e* of only approximately 2250 mm to 2270 mm results.

8. The pallet container as claimed in claim 1, characterized in that two pallet containers stacked on top of one another have an overall stack height H2*e* of only approximately 2250 mm to 2270 mm and are configured so as to be capable of being driven through the rear door of a 4" ISO container and being stacked by means of a fork lift truck in a two-tier stack, that is to say in a state stacked on top of one another, the rear door having an opening height HT of 2292 mm.

* * * * *